US007076964B2

(12) United States Patent
Sakakibara

(10) Patent No.: US 7,076,964 B2
(45) Date of Patent: Jul. 18, 2006

(54) SUPER-CRITICAL REFRIGERANT CYCLE SYSTEM AND WATER HEATER USING THE SAME

(75) Inventor: Hisayoshi Sakakibara, Nishio (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/263,244

(22) Filed: Oct. 2, 2002

(65) Prior Publication Data

US 2003/0061827 A1 Apr. 3, 2003

(30) Foreign Application Priority Data

Oct. 3, 2001 (JP) ..... 2001-307534

(51) Int. Cl.
*F25B 27/00* (2006.01)

(52) U.S. Cl. ..... 62/238.6; 62/224; 165/48.1

(58) Field of Classification Search ..... 62/174, 62/224, 165, 506, 504, 238.6, 238.7, 62, 62/99, 114, 228.3, 222, 210, 513; 165/48.1
See application file for complete search history.

(56) References Cited

U.S. PATENT DOCUMENTS 3,797,266 A * 3/1974 Newton ..... 62/223
5,025,634 A * 6/1991 Dressler ..... 62/79
5,245,836 A * 9/1993 Lorentzen et al. ..... 62/174
5,323,844 A * 6/1994 Sumitani et al. ..... 165/240
6,164,081 A * 12/2000 Jensen et al. ..... 62/115
6,370,896 B1 * 4/2002 Sakakibara et al. ..... 62/201
6,418,737 B1 * 7/2002 Kuroki et al. ..... 62/156
6,508,073 B1 * 1/2003 Noro et al. ..... 62/238.6

FOREIGN PATENT DOCUMENTS

JP 2001-82803 3/2001

* cited by examiner

*Primary Examiner*—Cheryl Tyler
*Assistant Examiner*—Michael J. Early
(74) *Attorney, Agent, or Firm*—Harness, Dickey & Pierce, PLC

(57) ABSTRACT

In a heat-pump water heater with a super-critical refrigerant cycle, a valve open degree of a decompression valve is controlled to control a pressure of high-pressure side refrigerant so that a temperature difference between refrigerant flowing out from the water-refrigerant heat exchanger and water flowing into a water-refrigerant heat exchanger is set in a predetermined temperature range. Thus, the pressure of high-pressure side refrigerant in the super-critical refrigerant cycle can be controlled, thereby suitably adjusting heat-exchange performance of an internal heat exchanger, and restricting the temperature of refrigerant discharged from the refrigerant compressor from being uselessly increased.

19 Claims, 6 Drawing Sheets

SUPER-CRITICAL REFRIGERANT CYCLE SYSTEM AND WATER HEATER USING THE SAME

CROSS-REFERENCE TO RELATED APPLICATION

This application is related to and claims priority from Japanese Patent Application No. 2001-307534 filed on Oct. 3, 2001, the content of which is hereby incorporated by reference.

BACKGROUND OF THE INVENTION

1. Field of the Invention

The present invention relates to a super-critical refrigerant cycle system in which pressure of refrigerant discharged from a refrigerant compressor is higher than the critical pressure of refrigerant. More particularly, the present invention relates to improvement of heat-exchange performance in a heat-pump water heater including a water-refrigerant heat exchanger where water to be used is heated by performing heat-exchange with high-pressure side refrigerant discharged from the refrigerant compressor.

2. Description of Related Art

As disclosed in JP-A-2001-82803, a conventional heat-pump water heater includes a water-refrigerant heat exchanger for heating water to be used by performing heat-exchange between the water and high-pressure side refrigerant discharged from a refrigerant compressor. As a heat source unit for heating the water, a super-critical heat pump cycle is used. In the super-critical heat pump cycle, carbon dioxide ($CO_2$) is used as refrigerant, and pressure of refrigerant discharged from the refrigerant compressor is higher than the critical pressure of refrigerant. The super-critical heat pump cycle is constructed so that refrigerant discharged from the refrigerant compressor is returned to the refrigerant compressor through the water-refrigerant heat exchanger, an expansion valve, a refrigerant evaporator and an accumulator in this order. It is known that water heating performance of the super-critical heat pump cycle is improved by adding an internal heat exchanger thereto. The internal heat exchanger is for performing heat-exchange between refrigerant flowing out from the water-refrigerant heat exchanger and refrigerant flowing out from the refrigerant evaporator.

However, when the internal heat exchanger is added, the temperature of refrigerant discharged from the refrigerant compressor is abnormally increased, thereby extremely reducing lives of components of the heat pump cycle. Therefore, a heat-exchange amount of the internal heat exchanger is required to be controlled, and a dedicated component for controlling the heat-exchange amount of the internal heat exchanger is required to be added, thereby increasing production cost of the heat pump cycle.

SUMMARY OF THE INVENTION

The present invention has been made in view of the above problem, and its object is to provide a super-critical refrigerant cycle system capable of preventing a temperature of refrigerant discharged from a refrigerant compressor from being abnormally increased without adding a dedicated component for controlling a heat-exchange amount of an internal heat exchanger.

According to the present invention, in a super-critical refrigerant cycle system, a refrigerant compressor compresses gas refrigerant to a pressure equal to or higher than the critical pressure of the refrigerant, a heating heat exchanger is disposed for heating a fluid by performing heat-exchange between the fluid and the refrigerant discharged from the refrigerant compressor, an internal heat exchanger is disposed for performing heat-exchange between refrigerant flowing out from the heating heat exchanger and refrigerant flowing toward the refrigerant compressor from a refrigerant evaporator, and a decompression valve is disposed for decompressing refrigerant from the internal heat exchanger and for supplying the decompressed refrigerant to the refrigerant evaporator. In the super-critical refrigerant cycle system, a controller controls a valve open degree of the decompression valve to control a pressure of high-pressure side refrigerant before being decompressed, such that a difference between a refrigerant outlet temperature and a fluid inlet temperature in the heating heat exchanger is set in a predetermined temperature range. Thus, the pressure of high-pressure side refrigerant discharged from the refrigerant compressor is adjusted by the valve open degree of the decompression valve. When low-temperature fluid flows into the heating heat exchanger, that is, when heat-exchange capacity of the internal heat exchanger is not required so much, the heat-exchange amount of the internal heat exchanger can be restricted. At this time, since the difference between the inlet fluid temperature and the outlet refrigerant temperature in the heating heat exchanger is set in the predetermined range, the outlet temperature of refrigerant becomes lower in the heating heat exchanger. Thus, a difference between the outlet refrigerant temperature in the heating heat exchanger and the temperature of refrigerant flowing out from the refrigerant evaporator becomes smaller, thereby restricting the heat-exchange amount of the internal heat exchanger.

On the other hand, when high-temperature fluid flows into the heating heat exchanger, that is, when large heat-exchanging capacity is required in the internal heat exchanger, the heat-exchanging amount of the internal heat exchanger is increased. That is, at this time, the outlet refrigerant temperature in the heating heat exchanger becomes higher, and the difference between the outlet refrigerant temperature in the heating heat exchanger and the temperature of refrigerant flowing out from the refrigerant evaporator becomes larger, thereby increasing the heat-exchanging amount of the internal heat exchanger. Thus, the internal heat exchanger is controlled so that the heat-exchanging amount of the internal heat exchanger is increased only when the effect of the internal heat exchanger can be performed. Therefore, the temperature of refrigerant discharged from the refrigerant compressor can be restricted from being uselessly increased, thereby increasing lives of components of the refrigerant cycle system while restricting production cost thereof.

The internal heat exchanger includes a first refrigerant heat-exchanging part disposed between the outlet of the heating heat exchanger and the decompression valve, and a second refrigerant heat-exchanging part disposed between an outlet of the refrigerant evaporator and a suction port of the refrigerant compressor. Preferably, the controller controls the valve open degree of the decompression valve such that a deference between an outlet temperature of refrigerant in the second refrigerant heat-exchanging part of the internal heat exchanger and an inlet temperature of refrigerant in the second refrigerant heat-exchanging part is set smaller than a predetermined temperature. Accordingly, it can prevent the refrigerant temperature discharged from the refrigerant compressor from being excessively increased.

Preferably, an accumulator disposed between the refrigerant evaporator and the second refrigerant heat-exchanging part of the interior heat exchanger has a storage chamber for temporarily storing refrigerant flowing from the refrigerant evaporator, and an outlet pipe inserted into the accumulator for mainly supplying gas refrigerant from the storage chamber to the refrigerant compressor through the second refrigerant heat-exchanging part of the internal heat exchanger. Further, the outlet pipe has an opening at its top end in the storage chamber, from which gas refrigerant is introduced from the storage chamber into the outlet pipe, an oil return hole at its lower portion in the storage chamber for introducing an oil in the refrigerant from the storage chamber into the outlet pipe, and a liquid-refrigerant return hole at its upper portion upper than the oil return hole in the storage chamber for introducing liquid refrigerant from the storage chamber into the outlet pipe. Here, the liquid-refrigerant return hole can be constructed by at least a single hole. Further, the liquid-refrigerant return hole is provided at a position which becomes equal to or lower than a liquid refrigerant surface in the storage chamber when the temperature of the fluid flowing into the heating heat exchanger is low, and which becomes higher than the liquid-refrigerant surface in the storage chamber when the temperature of the fluid flowing into the heating heat exchanger is high. Accordingly, the liquid refrigerant returning amount can be suitably adjusted, and the refrigerant temperature discharged from the refrigerant compressor can be readily adjusted.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the appended drawings.

First Embodiment

Figure 1:
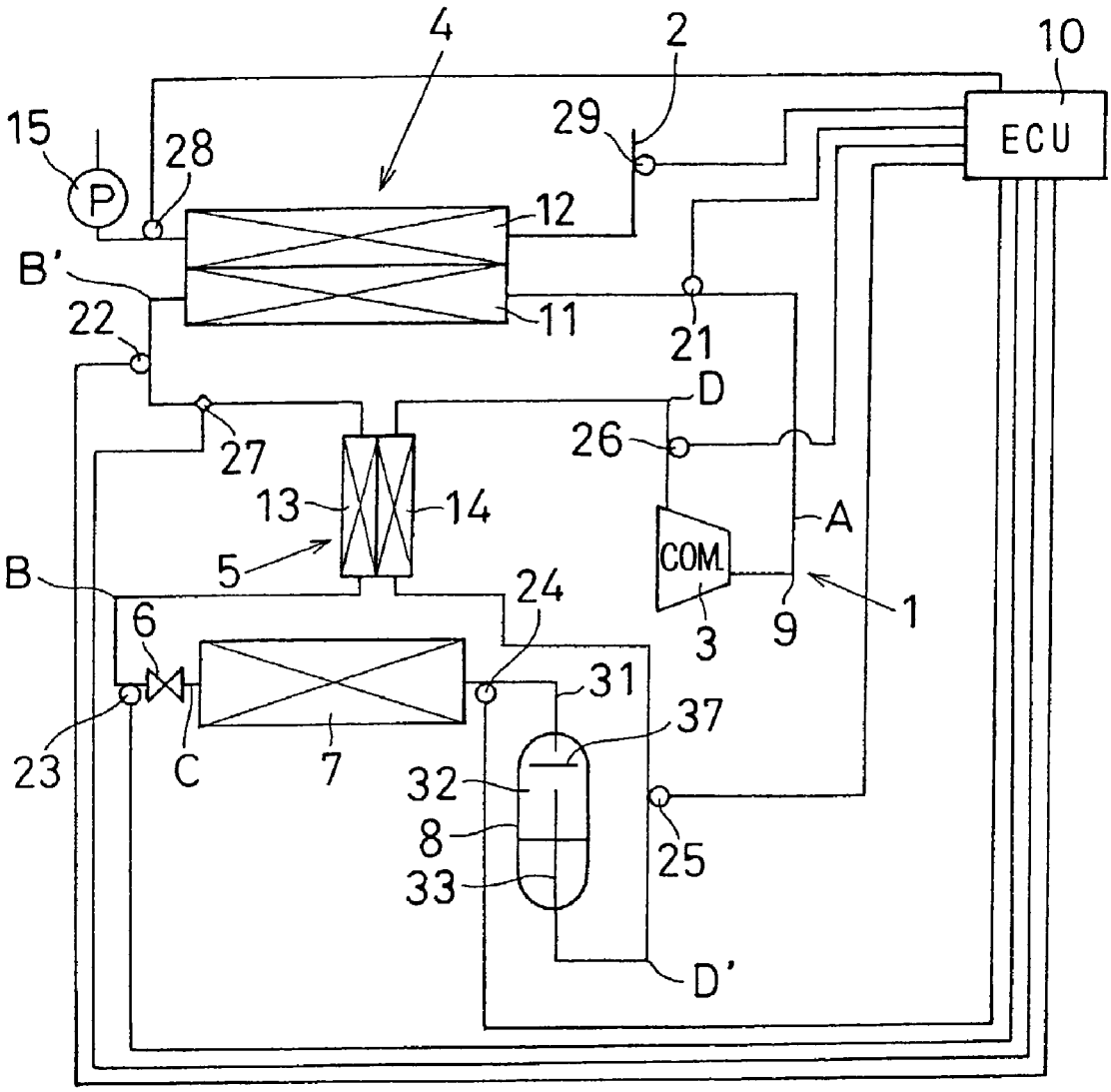
FIG. 1 is a schematic diagram showing a heat-pump water heater with a super-critical refrigerant cycle according to a first embodiment of the present invention.

A heat-pump water heater according to the first embodiment is an electric water heater mainly operated at night using midnight power that is cheaper in running cost, for example. As shown in FIG. 1, the heat-pump water heater includes a heat pump unit 1 used as a heat source for heating water, a hot water pipe 2, and an electronic control unit (ECU) 10 for electronically controlling actuators of the heat pump unit 1 and the hot water pipe 2. The hot water pipe 2 is for supplying water (fluid) heated by the heat pump unit 1, to a hot water tank (not shown), or to a bathroom and a washroom. In the first embodiment, the heat-pump water heater is constructed by a super-critical vapor-compression refrigerant cycle system.

The heat pump unit 1 includes a refrigerant compressor 3, a water-refrigerant heat exchanger (radiator) 4, an internal heat exchanger 5, a decompression valve 6, a refrigerant evaporator 7, an accumulator 8 and refrigerant pipe 9 connecting these components in an annular shape.

The refrigerant compressor 3 is driven and rotated by an electric motor (not shown) contained therein, for compressing and discharging refrigerant. Specifically, the refrigerant compressor 3 compresses gas refrigerant, sucked from the refrigerant evaporator 7, to a high pressure equal to or higher than the critical pressure of refrigerant in a working condition of the heat pump unit 1. The refrigerant compressor is operated when being energized (turned on), and is stopped when being de-energized (turned off). The water-refrigerant heat exchanger 4 is a heat exchanger for heating water using high-pressure side refrigerant discharged from the refrigerant compressor 3. A refrigerant heat exchanger 11 of the water-refrigerant heat exchanger 4 includes a refrigerant flow pipe through which high-pressure side refrigerant discharged from the refrigerant compressor 3 flows to perform heat exchange with water. The water-refrigerant heat exchanger 4 has a two-stacked heat exchanging structure where one end surface of the refrigerant heat exchanger 11 contacts one end surface of a water heat exchanger 12 so that heat-exchange can be effectively performed therebetween.

The internal heat exchanger 5 is a refrigerant-refrigerant heat exchanger for further evaporating refrigerant to be sucked into the refrigerant compressor 3 by performing heat-exchange between high-pressure side refrigerant flowing out from the refrigerant heat exchanger 11 of the water-refrigerant heat exchanger 4 and low-pressure refrigerant flowing out from the refrigerant evaporator 7 through the accumulator 8. The internal heat exchanger 5 has a two-stacked heat-exchanging structure where one end surface of a first refrigerant heat exchanger 13 contacts one end surface of a second refrigerant heat exchanger 14 so that heat-exchange can be effectively performed therebetween. The first refrigerant heat exchanger 13 includes a refrigerant flow pipe through which refrigerant, flowing out from the refrigerant heat exchanger 11 of the water-refrigerant heat exchanger 4, flows. The second refrigerant heat exchanger 14 includes a refrigerant flow pipe through which refrigerant, flowing out from the accumulator 8, flows. The internal heat exchanger 5 is constructed so that refrigerant in the first refrigerant heat exchanger 13 and refrigerant in the second refrigerant heat exchanger 14 can be heat-exchanged along entire length of each refrigerant flow pipe of the first and second refrigerant heat exchangers 13, 14.

The decompression valve 6 is a decompression device for decompressing refrigerant flowing out from the refrigerant heat exchanger 11 of the water-refrigerant heat exchanger 5 in accordance with its open degree. An electric expansion valve, electrically controlled by the ECU 10, is used as the decompression valve 6. The refrigerant evaporator 7 is an air-refrigerant heat exchanger (heat absorber) for evaporating refrigerant decompressed by the decompression valve 6 and for supplying the evaporated refrigerant to the refrigerant compressor 3 through the accumulator 8. Specifically, the refrigerant evaporator 7 evaporates the decompressed refrigerant using heat-exchange with outside air (fluid to be cooled) blown by a fan (not shown). The accumulator 8 has a storage chamber where refrigerant, flowing from the refrigerant evaporator 7, is temporarily stored.

For example, in the heat pump unit 1, carbon dioxide ($CO_2$) having low critical temperature is used as a main composition of the refrigerant. The heat pump unit 1 is constructed by a super-critical heat pump cycle (corresponding to a refrigerant cycle system of the present invention) where the pressure of high-pressure side refrigerant is equal to or higher than the critical pressure of refrigerant. In the super-critical heat pump cycle, the temperature of refrigerant at an inlet of the refrigerant heat exchanger 11, that is, the temperature of refrigerant discharged from the refrigerant compressor 3 can be increased to about 120° C. by increasing the pressure of high-pressure side refrigerant. Here, since refrigerant flowing into the refrigerant heat exchanger 11 is compressed by the refrigerant compressor 3 to be equal to or higher than the critical pressure, refrigerant cooled in the refrigerant heat exchanger 11 cannot be condensed and liquefied.

The hot water pipe 2 includes a water pump 15, a temperature adjustment valve (not shown) and the like. The water-refrigerant heat exchanger 4 is constructed so that refrigerant in the refrigerant heat exchanger 11 and water in the water heat exchanger 12 can be heat-exchanged along entire length of the refrigerant flow pipe of the refrigerant heat exchanger 11. Therefore, hot water having a desired temperature range (65–90° C.) can be taken out from the water heat exchanger 12. The water pump 15 is disposed in the hot water pipe 2, and is for circulating water, heated in the water heat exchanger 12, into the hot water tank. The hot water tank is for temporarily storing hot water from the water heat exchanger 12. The hot water tank includes a water supply inlet and a water supply outlet at its lower portion, and a hot water inlet and a hot water outlet at its higher portion. The water supply inlet is connected to a water supply pipe for supplying tap water and the like into the hot water tank, and the water supply outlet is for circulating water in the hot water tank into the water heat exchanger 12. Hot water generated in the water heat exchanger 12 flows into the hot water tank from the hot water inlet, and the hot water outlet is connected to the hot-water supply pipe.

The temperature adjustment valve is disposed in the hot water pipe 2, and is for adjusting the temperature of hot water at a desired temperature by adjusting a mixing ratio between high-temperature hot water heated in the water heat exchanger 12 or high-temperature hot water in the hot water tank, and low-temperature tap water from the water supply pipe. The temperature adjustment valve includes a valve body, for adjusting the above mixing ratio, driven by an actuator such as a motor. The temperature adjustment valve is constructed so that the temperature of hot water can be maintained at a target temperature by automatically adjusting a position of the valve body based on the temperature of hot water detected by a water temperature sensor. The ECU 10 includes a microcomputer constructed by a central processing unit (CPU), a read only memory (ROM), a random access memory (RAM), an input output port (I/O port), and the like. The ECU 10 electrically controls the water pump 15 and the temperature adjustment valve disposed in the hot water pipe 2 while electrically controlling the refrigerant compressor 3, the decompression valve 6 and the fan of the heat pump unit 1 based on operational signals and sensor signals. For example, operational signals are input from remote controllers provided on a wall surface of a bathroom and a wall surface of a washroom.

A refrigerant discharge temperature sensor 21 (corresponding to a discharge temperature detection device of the present invention) is for detecting the temperature of refrigerant discharged from the refrigerant compressor 3, and a refrigerant temperature sensor (corresponding to a refrigerant temperature detection device of the present invention) 22 is for detecting the temperature of refrigerant flowing from an outlet of the refrigerant heat exchanger 11. Analog sensor signals from the sensors 21, 22 are converted to digital sensor signals by an analog-digital conversion circuit (A/D conversion circuit, not shown), and thereafter the digital sensor signals are input to the microcomputer of the ECU 10. The discharge temperature sensor 21 is a refrigerant-inlet temperature detection device for detecting the temperature of refrigerant flowing into the refrigerant heat exchanger 11. A refrigerant temperature sensor 23 is for detecting the temperature of refrigerant flowing into the decompression valve 6 from the first refrigerant heat exchanger 13 of the internal heat exchanger 5, and a refrigerant temperature sensor 24 is for detecting a temperature of refrigerant flowing out from the refrigerant evaporator 7. Analog sensor signals from the sensors 23, 24 are converted to digital sensor signals by the A/D conversion circuit, and thereafter the digital sensor signals are input to the microcomputer of the ECU 10.

A refrigerant-inlet temperature sensor 25 (corresponding to a refrigerant-inlet temperature detection device of the present invention) is for detecting the temperature of refrigerant flowing into the second refrigerant heat exchanger 14 of the internal heat exchanger 5, and a refrigerant-outlet temperature sensor 26 (corresponding to a refrigerant-outlet temperature detection device of the present invention) is for detecting the temperature of refrigerant flowing out from the second refrigerant heat exchanger 14 of the internal heat exchanger 5. A refrigerant pressure sensor 27 is for detecting pressure of high-pressure side refrigerant. Analog sensor signals from the sensors 26-28 are converted to digital sensor signals by the A/D conversion circuit, and thereafter the digital sensor signals are input to the microcomputer of the ECU 10. The refrigerant-outlet temperature sensor 26 is a refrigerant-suction temperature detection device for detecting the temperature of refrigerant to be sucked into the refrigerant compressor 3. A water-inlet temperature sensor 28 (corresponding to a fluid temperature detection device of the present invention) is for detecting the temperature of water flowing into the water heat exchanger 12 of the water-refrigerant heat exchanger 4, and a water-outlet temperature sensor 29 is for detecting the temperature of hot water flowing out from the water heat exchanger 12. Analog sensor signals from the sensors 28, 29 are converted to digital sensor signals by the A/D conversion circuit, and thereafter the digital sensor signals are input to the microcomputer of the ECU 10.

The ECU 10 electrically controls a valve open degree of the decompression valve 6, that is, the pressure of high-pressure side refrigerant to set a difference between the water temperature detected by the water-inlet temperature sensor 28 and the refrigerant temperature detected by the refrigerant temperature sensor 22 within a predetermined temperature range (e.g., 10° C.). Thus, heat-exchange performance (heat-exchange amount) of the internal heat exchanger 5 is adjusted within a predetermined range. In order to prevent the temperature of refrigerant discharged from the refrigerant compressor 3 from being excessively increased, the ECU 10 may control the open degree of the decompression valve 6 to set a difference between the refrigerant temperature detected by the refrigerant-inlet temperature sensor 25 and the refrigerant temperature detected by the refrigerant-outlet temperature sensor 26 equal to or lower than a determination temperature difference X (predetermined temperature difference). Alternatively, in place of the temperature difference detected by the refrigerant temperature sensors 25, 26, the discharge temperature sensor 21 can be directly used. That is, the ECU 10 can control the open degree of the decompression valve 6 by setting the refrigerant temperature detected by the discharge temperature sensor 21 to be equal to or lower than the determination temperature difference X.

Figure 2:
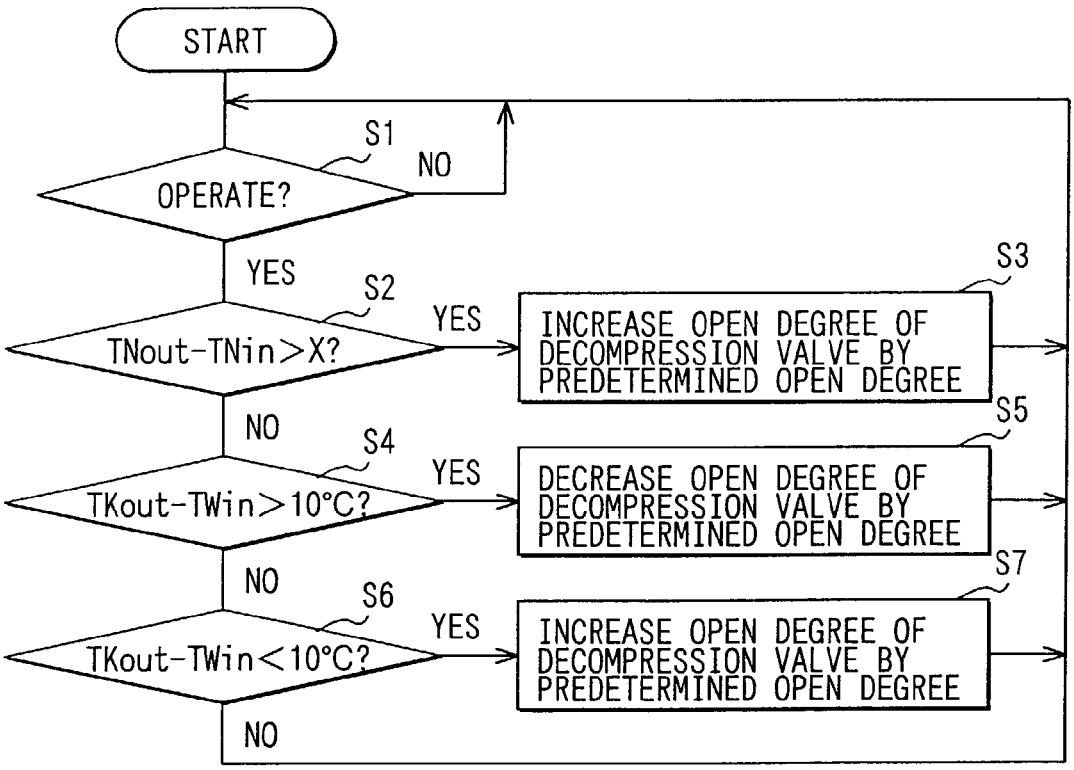
FIG. 2 is a flow diagram showing a pressure control of high-pressure side refrigerant in the super-critical heat pump cycle according to the first embodiment.

Next, a control method for controlling the heat-pump water heater according to the first embodiment will be described with reference to FIGS. 1–4. As shown in FIG. 2, at step S1, it is determined whether or not boiling operation (hot-water supply operation) is started by operating the remote controller provided on the wall surface of the bathroom or the washroom. When the determination at step S1 is NO, step S1 is repeated. When the determination at step S1 is YES, that is, when the boiling operation is determined to be started, the operation of the refrigerant compressor 3 of the heat pump unit 1 is started, and the operation of the water pump 15 provided in the hot water pipe 2 is started.

Figure 3:
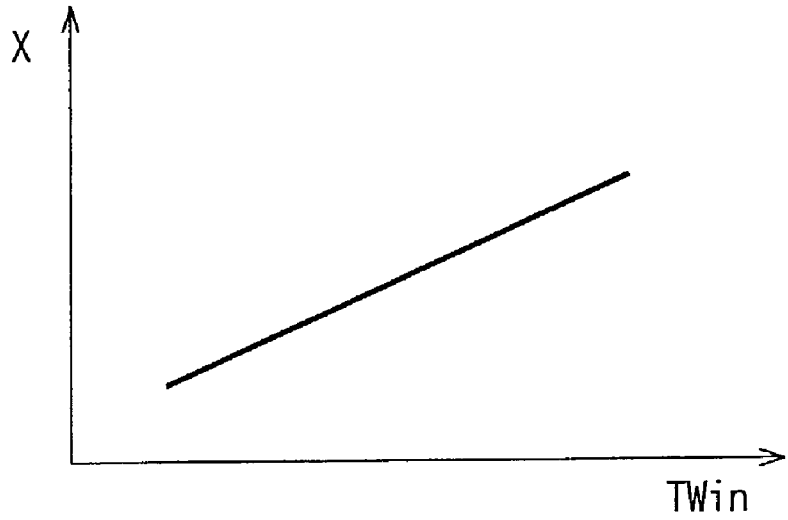
FIG. 3 is a graph showing a relationship between a determination temperature difference X and a water inlet temperature Twin of a water-refrigerant heat exchanger, according to the first embodiment.
Figure 4:
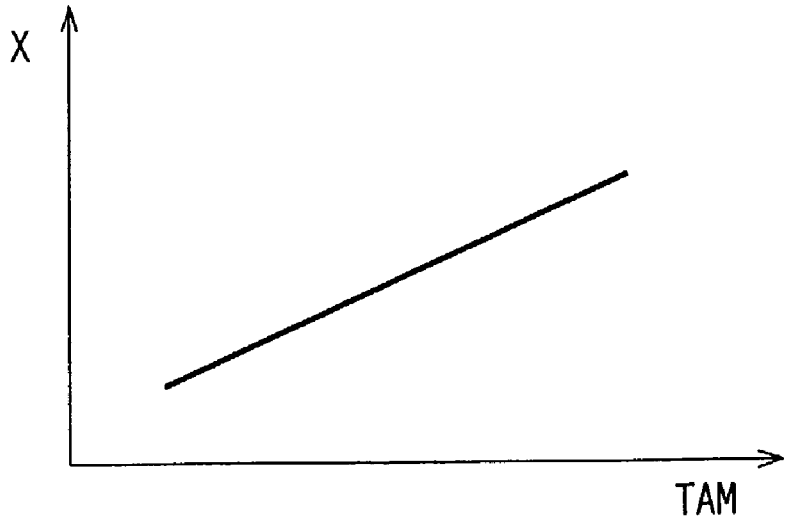
FIG. 4 is a graph showing a relationship between the determination temperature difference X and an outside air temperature TAM, according to the first embodiment.

At step S2, it is determined whether or not a difference (TNout−TNin) between an outlet temperature (TNout) of refrigerant flowing out from the second refrigerant heat exchanger 14 of the internal heat exchanger 5 and an inlet temperature (TNin) of refrigerant flowing into the second refrigerant heat exchanger 14 of the internal heat exchanger 5 is higher than the determination temperature difference X (e.g., 20° C.). The inlet temperature (TNin) is detected by the refrigerant-inlet temperature sensor 25, and the outlet temperature (TNout) is detected by the refrigerant-outlet temperature sensor 26. When the determination at step S2 is YES, it is determined that excessive heat-exchange is performed between the first and second refrigerant heat exchangers 13, 14 in the internal heat exchanger 5. Therefore, at step S3, the valve open degree of the decompression valve 6 is increased by a predetermined open degree, thereby reducing pressure of high-pressure side refrigerant in the super-critical heat pump cycle by predetermined pressure. For example, the valve open degree of the decompression valve 6 is increased by one step. As shown in FIG. 3, as the inlet temperature (TNin) of refrigerant flowing into the second refrigerant heat exchanger 14 of the internal heat exchanger 5 is increased, the determination temperature difference X of the refrigerant temperature difference (TNout−TNin) can be changed to be increased. The heat pump unit 1 and the water-refrigerant heat exchanger 4 are generally provided outside, and the hot water pipe 2, connecting the water-refrigerant heat exchanger 4 and a water supply unit provided inside, is exposed to outside air. Therefore, as an outside air temperature (TAM) is increased, the determination temperature difference X may be changed to be increased.

When the determination at step S2 is NO, it is determined whether or not a difference (TKout−TWin) between an outlet temperature (TKout) of refrigerant flowing out from the refrigerant heat exchanger 11 of the water-refrigerant heat exchanger 4 and an inlet temperature (TWin) of water flowing into the water heat exchanger 12 is higher than a predetermined temperature Y (e.g., 10° C.) at step S4. The outlet temperature (TKout) is detected by the refrigerant temperature sensor 22, and the inlet temperature (TWin) is detected by the water-inlet temperature sensor 28. When the determination at step S4 is YES, it is determined that the pressure of high-pressure side refrigerant in the heat pump cycle is excessively low. Therefore, at step S5, the valve open degree of the decompression valve 6 is reduced by a predetermined open degree, thereby increasing pressure of high-pressure side refrigerant in the super-critical heat pump cycle by predetermined pressure. For example, at step S5, the valve open degree of the decompression valve 6 is decreased by one step.

When the determination is NO at step S4, it is determined whether or not the temperature difference (TKout−TWin) is lower than the predetermined temperature Y at step S6. When the determination is YES at step S6, it is determined that the pressure of high-pressure side refrigerant in the heat pump cycle is excessively high. Therefore, at step S7, the valve open degree of the decompression valve 6 is increased by a predetermined open degree (e.g., by one step), thereby reducing the pressure of high-pressure side refrigerant in the super-critical heat pump cycle by predetermined pressure. Thereafter, a control step is returned to step S1. When the determination is NO at step S6, that is, when the temperature difference (TKout−TWin) is determined to be equal to or higher the predetermined temperature Y, the valve open degree of the decompression valve 6 is controlled to be maintained at the previous valve open degree, and the control routine is returned to step S1. The predetermined temperature Y can be set at a temperature in a range of 5–15° C., or can be changed in accordance with the outside air temperature TAM. At steps S4 and S6, the predetermined temperature Y can be set at different temperatures. Further, in this embodiment, the open degree of the decompression valve 6 is controlled such that the temperature difference (TKout−TWin) can be set in a predetermined temperature range including a predetermined temperature.

Figure 5:
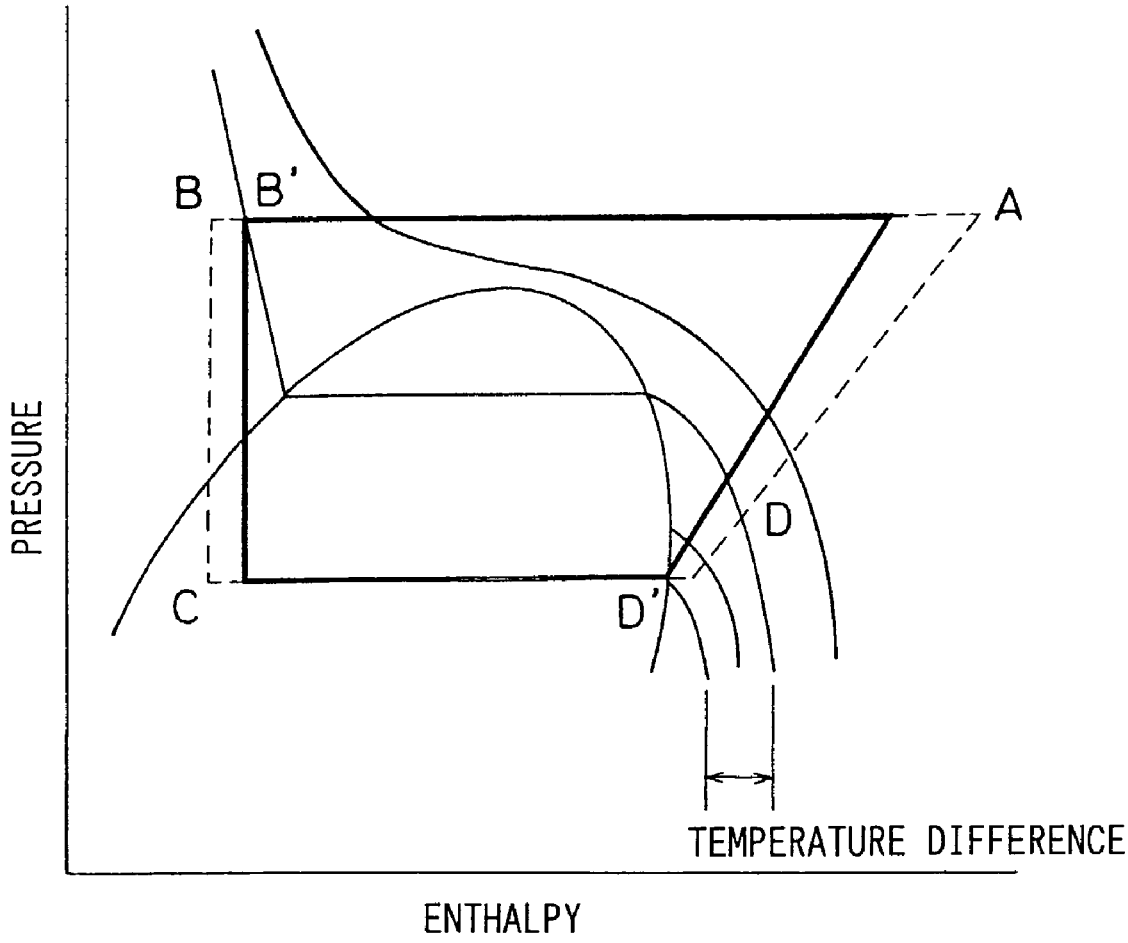
FIG. 5 is a Mollier diagram of the heat pump cycle when the water inlet temperature TWin is low, according to the first embodiment.
Figure 6:
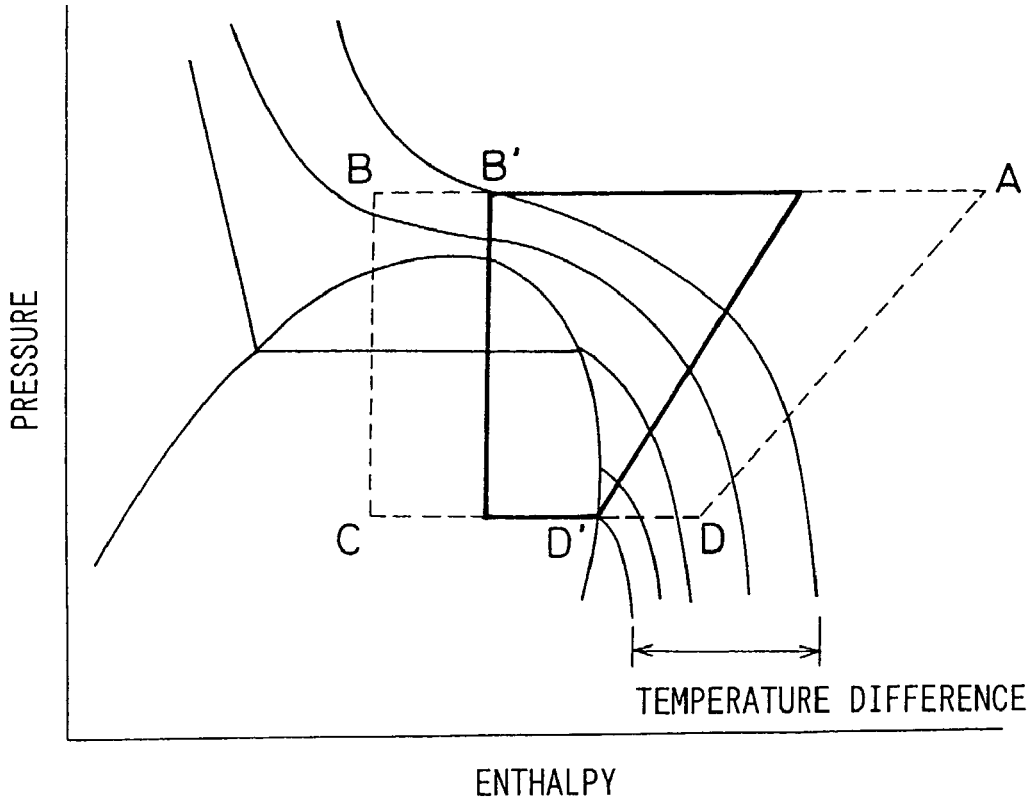
FIG. 6 is a Mollier diagram of the heat pump cycle when the water inlet temperature TWin is high, according to the first embodiment.

Next, operation of the heat pump water heater according to the first embodiment will be described with reference to FIGS. 1–7. FIGS. 5 and 6 are Mollier diagrams each showing states of refrigerant in a refrigerant circuit of the super-critical heat pump cycle. The refrigerant states A–D in FIG. 1 correspond to the refrigerant states A–D shown in FIGS. 5 and 6, respectively. When the operation of the water pump 15 is started, water is circulated into the water heat exchanger 12. When refrigerant is compressed by the refrigerant compressor 3, the refrigerant state becomes super critical, and the temperature of refrigerant discharged from the refrigerant compressor 3 becomes high. High-pressure gas refrigerant, discharged from the refrigerant compressor 3, is in the refrigerant state A in FIGS. 1, 5 and 6, and flows into the refrigerant heat exchanger 11 of the water-refrigerant heat exchanger 4. Then, heat from the gas refrigerant flowing in the refrigerant heat exchanger 11 is transmitted to water flowing in the water heat exchanger 12, so that the gas refrigerant is cooled, that is, the refrigerant state A is changed to the refrigerant state B'. At this time, on the contrary, the temperature of water flowing through the water heat exchanger 12 is heated to approximate 65–90° C., and is supplied to the hot water pipe 2.

Refrigerant flows from the refrigerant heat exchanger 11 of the water-refrigerant heat exchanger 4 into the first refrigerant heat exchanger 13 of the internal heat exchanger 5. Accordingly, in the internal heat exchanger 5, heat is transmitted from refrigerant flowing in the first refrigerant heat exchanger 13 to refrigerant flowing in the second refrigerant heat exchanger 14, so that refrigerant flowing the first refrigerant heat exchanger 13 is cooled, that is, the refrigerant state B' is changed to the refrigerant state B. Then, refrigerant flows from the first refrigerant heat exchanger 13 into the decompression valve 6 where refrigerant is decompressed to gas-liquid refrigerant when passing through a valve opening, that is, the refrigerant state B is changed to the refrigerant state C. Thereafter, the gas-liquid refrigerant flows into the refrigerant evaporator 7, where the gas-liquid refrigerant is heat-exchanged with outside air and is evaporated to become gas refrigerant, that is, the refrigerant state C is changed to the refrigerant state D'.

Refrigerant flows from the refrigerant evaporator 7 into the accumulator 8. Since all of refrigerant flowing into the accumulator 8 is not evaporated, liquid refrigerant is temporarily stored in the accumulator 8, and only gas refrigerant is supplied into the second refrigerant heat exchanger 14 of the internal heat exchanger 5. Accordingly, heat is transmitted from refrigerant flowing in the first refrigerant heat exchanger 13 to refrigerant flowing in the second refrigerant heat exchanger 14, so that gas refrigerant flowing in the second refrigerant heat exchanger 14 becomes super-heated gas refrigerant, that is, the refrigerant state D' is changed to the refrigerant state D. Refrigerant flows out from the second refrigerant heat exchanger 14 of the internal heat exchanger 5, and is sucked into the refrigerant compressor 3. The refrigerant sucked into the refrigerant compressor is again compressed.

Next, operational effects of the heat-pump water heater according to the first embodiment will be described. In the heat-pump water heater, the pressure of high-pressure side refrigerant in the super-critical heat pump cycle can be adjusted by controlling the valve open degree of the decompression valve 6 so that the temperature difference (TKout–TWin) can be set in the predetermined temperature range Y. Therefore, the heat-exchange performance of the internal heat exchanger 5 can be adjusted in the predetermined range. When low-temperature water flows into the water-refrigerant heat exchanger 4, that is, when heat-exchange performance is not required so much for the internal heat exchanger 5, the temperature of refrigerant flowing out from the second refrigerant heat exchanger 14 is reduced by adjusting the temperature difference (TKout–TWin) in the predetermined temperature range Y. Therefore, as shown in FIG. 5, when the low-temperature water flows into the water-refrigerant heat exchanger 4, a difference between a refrigerant evaporation temperature and a temperature of refrigerant flowing out from the second refrigerant heat exchanger 14 becomes small, thereby reducing the heat-exchange performance (heat-exchange amount) of the internal heat exchanger 5.

On the other hand, when high-temperature water flows into the water-refrigerant heat exchanger 4, that is, when large heat-exchange performance is required for the internal heat exchanger 5, the temperature of refrigerant flowing out from the second refrigerant heat exchanger 14 is increased. Therefore, as shown in FIG. 6, when the high-temperature water flows into the water-refrigerant heat exchanger 4, a difference between the refrigerant evaporation temperature and the temperature of refrigerant flowing out from the second refrigerant heat exchanger 14 becomes large, thereby increasing the heat-exchange amount of the internal heat exchanger 5. Accordingly, only when the effect of the internal heat exchanger 5 can be expected, the heat-exchange amount of the internal heat exchanger 5 is adjusted at a level where the heat-exchange performance of the internal heat exchanger 5 can be obtained, thereby restricting the temperature of refrigerant discharged from the refrigerant compressor 3 from being uselessly increased. Therefore, lives of components of the heat-pump cycle can be increased without adding a dedicated component for adjusting the heat-exchange amount of the internal heat exchanger. Accordingly, it can prevent production cost from being increased while restricting the temperature of refrigerant discharged from the refrigerant compressor 3 from being uselessly increased.

Figure 7:
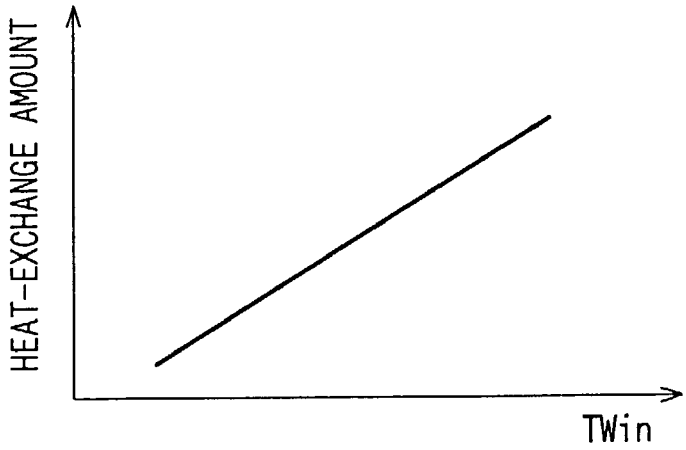
FIG. 7 is a graph showing a relationship between a heat-exchange amount of an internal heat exchanger and the water inlet temperature TWin, according to the first embodiment.

Further, the valve open degree of the decompression valve 6 is controlled, so that the refrigerant temperature difference between outlet and inlet sides of the second refrigerant heat exchanger 14, detected by the refrigerant temperature sensors 25, 26, is set equal to or lower than the determination temperature difference X. That is, the temperature of refrigerant at an outlet of the second refrigerant heat exchanger 14 and a temperature of refrigerant at an inlet thereof are detected, and the difference between the detected temperatures is adjusted to be equal to or lower than the predetermined temperature, in order to prevent the temperature of refrigerant discharged from the refrigerant compressor 3 from being excessively increased. In this embodiment, as shown in FIGS. 2 and 7, the temperature difference control at the outlet and inlet of the second refrigerant heat exchanger 14 is preferentially performed with respect to the temperature difference control between the refrigerant outlet temperature (TKout) and the water inlet temperature (TWin) in the water-refrigerant heat exchanger 4.

Accordingly, the temperature of refrigerant discharged from the refrigerant compressor 3 can be reduced, and the pressure of high-pressure side refrigerant can be reduced. Here, the temperature of refrigerant discharged from the refrigerant compressor 3 can be directly detected in place of the temperature difference between the outlet refrigerant temperature and the inlet refrigerant temperature of the second refrigerant heat exchanger 14. Then, the pressure of high-pressure side refrigerant in the super-critical heat pump cycle and the heat-exchange amount of the internal heat exchanger 5 may be adjusted by controlling the valve open degree of the decompression valve 6.

Second Embodiment

Figure 8A:
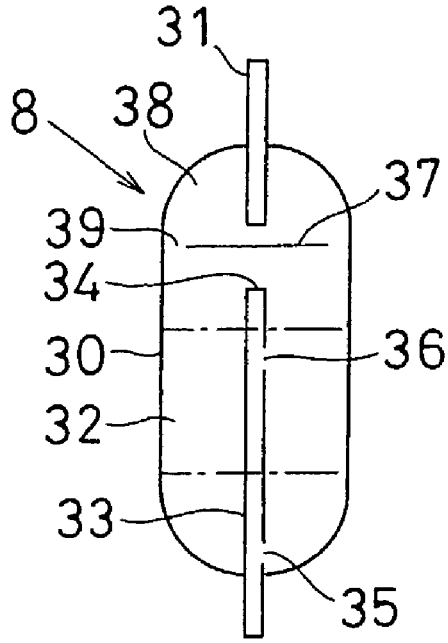
FIG. 8A is a schematic perspective diagram showing an accumulator according to a second embodiment of the present invention.

In the second embodiment, the structure of the accumulator 8 shown in FIG. 1 is described in detail. As shown in FIG. 8A, the accumulator 8 includes a container body 30 having an elliptical cross-section, an inlet pipe 31 for introducing refrigerant into the container body 30 from the refrigerant evaporator 7, a storage chamber 32 for temporarily storing refrigerant flowing into the container body 30, an outlet pipe 33 for supplying the refrigerant stored in the storage chamber 32 to the suction side of the refrigerant compressor 3, and the like. The outlet pipe 33 is connected to the suction side of the refrigerant compressor 3 outside the storage chamber 32 of the accumulator 8.

An opening (gas-refrigerant return opening) 34 is provided on the outlet pipe 33 at its top end inside the storage chamber of the accumulator 8. An oil return hole 35 for introducing lubricating oil (e.g., refrigerator oil such as PAG) into the outlet pipe 33 from the storage chamber 32 is provided on the outlet pipe 33 at its bottom side inside the storage chamber 32 of the accumulator 8. The oil (lubricating oil), for lubricating sliding portions of the refrigerant compressor 3, is stored in the storage chamber 32 at the bottom side portion. Therefore, the oil return hole 35 is provided in the outlet pipe 33 at its bottom side in the storage chamber 32, to return the oil to the refrigerant compressor 3. Here, a diameter of the outlet pipe 33 inside the storage chamber 32 is set larger than that outside the storage chamber 32. That is, the outlet pipe 33 is formed by a copper pipe having different diameters at the inside and outside of the storage chamber 32. Accordingly, a pressure loss in the outlet pipe 33 can be suitably set, and an amount of oil sucked from the oil return hole 35 can be suitably controlled. On the other hand, the outlet pipe 33 outside the storage chamber 32 is formed by a copper pipe having a diameter set based on a balance between pressure resistance of the outlet pipe 33, a pressure loss therein and production cost thereof.

A liquid-refrigerant return hole 36 having an approximate circular shape, for introducing liquid refrigerant into the outlet pipe 33 from the storage chamber 32, is provided in the outlet pipe 33 at its upper portion in the storage chamber 32. A baffle plate (shield plate) 37 for shielding a refrigerant flow from the refrigerant evaporator 7 to the container body 30 is provided to prevent the refrigerant from being directly introduced into the outlet pipe 33 from the opening 34. The baffle plate 37 is provided at an upper side in the storage chamber 32, and includes plural communication holes 39 through which an inlet chamber 38 at the upper side of the container body 30 upper than the baffle plate 37 and the storage chamber 32 lower than the baffle plate 37 communicate with each other. The liquid-refrigerant return hole 36 is provided in the outlet pipe 33 at a position which is covered by liquid refrigerant when outside air temperature is low, and which is not covered by liquid refrigerant when outside air temperature is high. Here, oil return operation is required when the outside air temperature is low, and is not required when the outside air temperature is high. An open area of the liquid-refrigerant return hole 36 is set smaller than that of the opening 34.

Figure 8B:
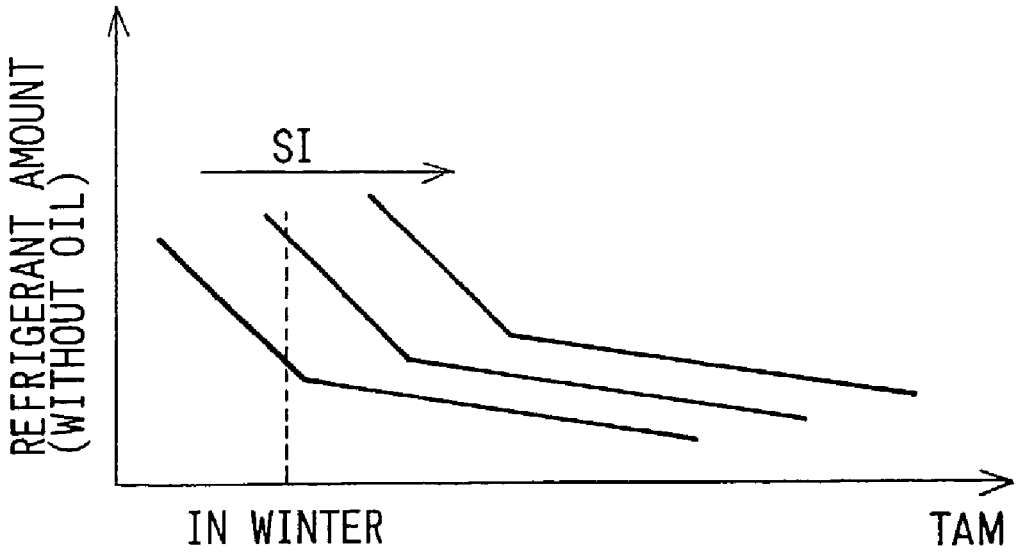
FIG. 8B is a graph showing a relationship between the outside air temperature TAM and a refrigerant amount in the accumulator shown in FIG. 8A, according to the second embodiment.

Next, operation of the heat-pump water heater according to the second embodiment will be described with reference to FIGS. 1 and 8A–8B. Refrigerant flows out from the refrigerant evaporator 7, and flows into the inlet chamber 38 of the accumulator 8 from the inlet pipe 31. Then, the refrigerant collides with the baffle plate 37, and flows into the storage chamber 32 through the communication holes 39 of the baffle plate 37. Since the refrigerant includes gas refrigerant and liquid refrigerant, the liquid refrigerant is temporarily stored in the storage chamber 32, and only the gas refrigerant flows into the outlet pipe 33 from the opening 34. Then, the gas refrigerant is sucked to the refrigerant compressor 3, to be compressed again.

When the temperature of outside air (to be cooled), which is heat-exchanged with refrigerant in the refrigerant evaporator 7, is low, the pressure (evaporation pressure) of low-pressure refrigerant is reduced, and a larger amount of liquid refrigerant tends to be stored in the storage chamber 32. Therefore, a liquid surface level is increased in the storage chamber 32 than in a normal state, and becomes higher than the liquid-refrigerant return hole 36. In this case, a suitable amount of liquid refrigerant is returned to the refrigerant cycle from the liquid-refrigerant return hole 36, and the temperature of refrigerant sucked into the refrigerant compressor 3 becomes lower. Therefore, the temperature of refrigerant discharged from the refrigerant compressor 3 becomes lower by compressing refrigerant having a relative lower temperature, thereby restricting the temperature of refrigerant discharged from the refrigerant compressor 3 at a suitable temperature.

At this time, if the diameter of the liquid-refrigerant return hole 36 is made larger than that of the opening 34, high-density liquid refrigerant flowing into the outlet pipe 33 from the liquid-refrigerant return hole 36 has a smaller pressure loss due to a contraction flow than gas refrigerant flowing thereinto from the opening 34. Therefore, most of refrigerant flowing into the outlet pipe 33 is liquid refrigerant, and cannot be compressed by the refrigerant compressor 3, thereby increasing consumption power of the refrigerant compressor 3 and reducing a performance coefficient thereof. Accordingly, in the second embodiment, the opening area of the liquid-refrigerant return hole 36 is set to be sufficiently smaller than that of the opening 34. In the second embodiment, the opening of the liquid-refrigerant hole 36 is set at 2% of that of the opening 34. When the temperature of outside air, which is heat-exchanged with gas-liquid refrigerant in the refrigerant evaporator 7, is further lower, a liquid surface becomes further higher than the liquid-refrigerant return hole 36. In this case, since a distance between the liquid surface and the liquid-refrigerant return hole 36 becomes larger, the amount of refrigerant returned into the outlet pipe 33 becomes larger, thereby further reducing the temperature of refrigerant sucked into the refrigerant compressor 3. Therefore, the temperature of refrigerant discharged from the refrigerant compressor 3 is further reduced by compressing refrigerant having a further lower temperature, thereby more effectively reducing the temperature of refrigerant discharged from the refrigerant compressor 3.

Next, operational effects of the heat-pump water heater according to the second embodiment will be described. In the heat-pump water heater, as the outside air temperature TAM becomes lower, the temperature of water flowing into the water heat exchanger 12 becomes lower, thereby increasing the amount of liquid refrigerant stored in the storage chamber 32 of the accumulator 8, that is, increasing the liquid surface level of liquid refrigerant. Using the characteristic that the liquid surface level of liquid refrigerant is increased as the outside air temperature becomes lower, the refrigerant amount circulating in the super-critical heat pump cycle, that is, the liquid refrigerant amount in the storage chamber 32 of the accumulator 8 can be adjusted. Therefore, as shown by the arrow SI in FIG. 8B, a larger amount of liquid refrigerant can be stored in the storage chamber 32 when the outside air temperature TAM is low. On the other hand, the oil is almost mainly stored in the storage chamber 32 when the outside air temperature TAM is high.

Thus, when the outside air temperature TAM is low, refrigerant containing a large amount of liquid refrigerant can be returned to the refrigerant compressor 3 from the storage chamber 32 of the accumulator 8 through the outlet pipe 33. At this time, liquid refrigerant is preferentially evaporated in the second refrigerant heat exchanger 14 of the internal heat exchanger 5, thereby reducing the temperature of refrigerant sucked into the refrigerant compressor 3. As a result, when the outside air temperature is low, the temperature of refrigerant discharged from the refrigerant compressor 3 can be restricted from being increased. In the second embodiment, the amount of liquid refrigerant returned from the storage chamber 32 of the accumulator 8 into the refrigerant compressor 3 is increased by using the characteristic where the liquid refrigerant amount is increased as the outside air temperature becomes lower as shown by the arrow SI in FIG. 8B. Further, when a variable-discharge capacity compressor is used as the refrigerant compressor 3, the pressure of high-pressure side refrigerant discharged from the refrigerant compressor 3 may be adjusted by changing the discharge capacity of the variable-discharge capacity refrigerant compressor.

In the second embodiment, the other parts are similar to those of the above-described first embodiment, and the detail description thereof is omitted.

Although the present invention has been fully described in connection with the preferred embodiments thereof with reference to the accompanying drawings, it is to be noted that various changes and modifications will become apparent to those skilled in the art.

For example, the present invention can be applied to a direct-supply water heater including the hot-water pipe 2 for supplying the hot water heated by the heat pump unit 1 directly to a bathroom and a washroom without using the hot water tank as in the above embodiments. Further, the present invention can be applied to a water heater where the water to be supplied is heated by using a fluid (water) flowing into a fluid-refrigerant heat exchanger where the fluid and the refrigerant discharged from the refrigerant compressor 3 is heat exchanged.

In the first embodiment, the valve open degree of the decompression valve 6 is controlled so that the temperature difference (TKout−TWin) between the refrigerant temperature at the outlet of the water-refrigerant heat exchanger 4 and the water temperature at the inlet thereof is set in the predetermined temperature range Y (e.g., 10° C.). However, the predetermined temperature range Y can be changed in accordance with heating loads such as the outside temperature and a supply water temperature.

In the second embodiment, the liquid-refrigerant return hole 36 can be constructed by plural holes. In this case, a total open area of the liquid-refrigerant return holes 36 is set smaller than the open area of the opening 34.

Such changes and modifications are to be understood as being within the scope of the present invention as defined by the appended claims.

What is claimed is:

1. A super-critical refrigerant cycle system comprising:

a refrigerant compressor for compressing refrigerant to a pressure equal to or higher than critical pressure of the refrigerant;

a heating heat exchanger having a first section through which the refrigerant flows and a separate second section through which a fluid other than the refrigerant flows, the heating heat exchanger heating the fluid by performing heat-exchange between the fluid and the refrigerant discharged from the refrigerant compressor;

a refrigerant evaporator for evaporating refrigerant;

an internal heat exchanger for performing heat-exchange between refrigerant flowing out from the heating heat exchanger and refrigerant flowing toward the refrigerant compressor after leaving the refrigerant evaporator;

a decompression valve for decompressing refrigerant coming directly from the internal heat exchanger, and for supplying the decompressed refrigerant to the refrigerant evaporator; and a controller that controls a valve open degree of the decompression valve to control a pressure of high-pressure side refrigerant after leaving the heating heat exchanger and before being decompressed to continuously set a state where a difference between a refrigerant outlet temperature of the first section of the heating heat exchanger and a fluid inlet temperature of the second section of the heating heat exchanger approaches a predetermined temperature value.

2. The super-critical refrigerant cycle system according to claim 1, further comprising:

a fluid-temperature detection device for detecting the fluid inlet temperature at an inlet side of the fluid in the heating heat exchanger;

an outlet refrigerant-temperature detection device for detecting the refrigerant outlet temperature at an outlet side of refrigerant in the heating heat exchanger.

3. The super-critical refrigerant cycle system according to claim 1, wherein the internal heat exchanger includes a first refrigerant heat-exchanging part disposed between an outlet of the heating heat exchanger and the decompression valve, and a second refrigerant heat-exchanging part disposed between an outlet of the refrigerant evaporator and a suction port of the refrigerant compressor, the system further comprising:

a first refrigerant-temperature detection device for detecting an inlet temperature of refrigerant flowing into the second refrigerant heat-exchanging part of the internal heat exchanger; and a second refrigerant-temperature detection device for detecting an outlet temperature of refrigerant flowing out from the second refrigerant heat-exchanging part of the internal heat exchanger; and the controller controls the valve open degree of the decompression valve such that a deference between the outlet temperature of refrigerant and the inlet temperature of refrigerant in the second refrigerant heat-exchanging part is set smaller than a predetermined temperature.

4. The super-critical refrigerant cycle system according to claim 1, further comprising a discharge refrigerant-temperature detection device for detecting a discharge temperature of refrigerant discharged from the refrigerant compressor, wherein the controller controls the valve open degree of the decompression valve such that the discharge temperature of refrigerant becomes lower than a predetermined temperature.

5. The super-critical refrigerant cycle system according to claim 1, further comprising an accumulator including a storage chamber for temporarily storing refrigerant flowing from the refrigerant evaporator, and an outlet pipe inserted into the accumulator for mainly supplying gas refrigerant from the storage chamber to the refrigerant compressor through the internal heat exchanger, wherein:

the outlet pipe has an opening at its top end in the storage chamber, from which gas refrigerant is introduced from the storage chamber into the outlet pipe, an oil return hole at its lower portion in the storage chamber, for introducing an oil in the refrigerant from the storage chamber into the outlet pipe, and a liquid-refrigerant return hole at its upper portion upper than the oil return hole in the storage chamber, for introducing liquid refrigerant from the storage chamber into the outlet pipe.

6. The super-critical refrigerant cycle system according to claim 5, wherein:

the liquid-refrigerant return hole is provided at a position which becomes equal to or lower than a liquid refrigerant surface in the storage chamber when the temperature of the fluid flowing into the heating heat exchanger is low, and which becomes higher than the liquid-refrigerant surface in the storage chamber when the temperature of the fluid flowing into the heating heat exchanger is high.

7. The super-critical refrigerant cycle system according to claim 5, wherein:

the refrigerant evaporator is disposed to evaporate refrigerant by absorbing heat from air; and the liquid-refrigerant return hole is provided at a position which becomes equal to or lower than a liquid refrigerant surface in the storage chamber when the temperature of air flowing to the refrigerant evaporator is low, and which becomes higher than the liquid-refrigerant surface in the storage chamber when the temperature of air flowing to the refrigerant evaporator is high.

8. The super-critical refrigerant cycle system according to claim 5, wherein an open area of the liquid-refrigerant return hole is set smaller than that of the opening at the top end of the outlet pipe.

9. The super-critical refrigerant cycle system according to claim 5, wherein:

the oil is a lubrication oil used for the refrigerant compressor, that is undissolvable with liquid refrigerant in the storage chamber; and the oil has a density larger than that of the liquid refrigerant.

10. The super-critical refrigerant cycle system according to claim 1, wherein:

the heating heat exchanger is disposed to heat water to be supplied by using the fluid as a heating source.

11. The super-critical refrigerant cycle according to claim 1, wherein:

the fluid is water to be supplied; and the heating heat exchanger is disposed to perform heat exchange between the water and the refrigerant discharged from the compressor to heat the water to be supplied.

12. A water heater for heating water to be supplied, comprising:

a refrigerant compressor for compressing refrigerant to a pressure equal to or higher than critical pressure of the refrigerant;

a heating heat exchanger having a first section through which the refrigerant flows and a separate second section through which the water flows, the heating heat exchanger heating the water to a predetermined temperature by performing heat-exchange between the water and the refrigerant discharged from the refrigerant compressor;

a refrigerant evaporator for evaporating refrigerant by absorbing heat from air;

an internal heat exchanger for performing heat-exchange between refrigerant flowing out from the heating heat exchanger and refrigerant flowing toward the refrigerant compressor from the refrigerant evaporator;

a decompression valve for decompressing refrigerant from the internal heat exchanger, and for supplying the decompressed refrigerant to the refrigerant evaporator;

a water-temperature detection device for detecting a water inlet temperature before being heat-exchanged in the heating heat exchanger;

an outlet refrigerant-temperature detection device for detecting a refrigerant outlet temperature after being heat-exchanged in the heating heat exchanger; and a controller that controls a valve open degree of the decompression valve to continuously set a state where a difference between a refrigerant outlet temperature of the first section of the heating heat exchanger and a water inlet temperature of the second section of the heating heat exchanger approaches a predetermined temperature value.

13. The super-critical refrigerant cycle according to claim 1, wherein heating heat exchanger has a fluid passage through which the fluid flows, and a refrigerant passage through which the refrigerant flows in a flow direction opposite to that of the fluid in the fluid passage.

14. The water heater according to claim 12, wherein heating heat exchanger has a water passage through which water flows, and a refrigerant passage through which the refrigerant flows in a flow direction opposite to that of water in the water passage.

15. The super-critical refrigerant cycle system according to claim 1, wherein the predetermined temperature value is changed in accordance with an outside air temperature.

16. The super-critical refrigerant cycle system according to claim 1, wherein the predetermined temperature value is set in a range of 5–15° C.

17. The super-critical refrigerant cycle system according to claim 1, wherein the fluid is water to be supplied to a water tank, and the heating heat exchanger heats the water flowing from the water tank.

18. The super-critical refrigerant cycle system according to claim 1, wherein the internal heat exchanger has a first portion and a separate second portion, the first portion being disposed between the first section of the heating heat exchanger and the decompression valve, the second portion being disposed between the evaporator and the compressor.

19. The super-critical refrigerant cycle system according to claim 12, wherein the internal heat exchanger has a first portion and a separate second portion, the first portion being disposed between the first section of the heating heat exchanger and the decompression valve, the second portion being disposed between the evaporator and the compressor.

* * * * *